US007055981B2

(12) United States Patent
Yao

(10) Patent No.: US 7,055,981 B2
(45) Date of Patent: Jun. 6, 2006

(54) STRETCHABLE AND SHRINKABLE TREE LIGHT STRINGS

(75) Inventor: Joseph Yao, Taipei (TW)

(73) Assignee: Willis Electric Co., Ltd., Hsin-Chu (TW)

( * ) Notice: Subject to any disclaimer, the term of this patent is extended or adjusted under 35 U.S.C. 154(b) by 219 days.

(21) Appl. No.: 10/677,915

(22) Filed: Oct. 2, 2003

(65) Prior Publication Data

US 2004/0257799 A1 Dec. 23, 2004

(30) Foreign Application Priority Data

Mar. 11, 2003 (CN) ..... 03238504 U

(51) Int. Cl.
*F21V 21/00* (2006.01)

(52) U.S. Cl. ..... 362/123; 362/252; 362/806; 428/20

(58) Field of Classification Search ..... 362/123, 362/252, 806, 250, 427, 287, 249; 428/9, 428/20, 18; 211/196, 205
See application file for complete search history.

(56) References Cited

U.S. PATENT DOCUMENTS

| | | | | |
|---|---|---|---|---|
| 3,970,834 | A * | 7/1976 | Smith | 362/123 |
| 4,140,823 | A * | 2/1979 | Weskamp | 428/9 |
| 4,441,447 | A * | 4/1984 | Alter et al. | 114/167 |
| 4,496,615 | A * | 1/1985 | Huang | 428/9 |
| 5,550,720 | A * | 8/1996 | Carroll | 362/123 |
| 5,820,248 | A * | 10/1998 | Ferguson | 362/123 |
| 6,514,581 | B1 * | 2/2003 | Gregory | 428/20 |

* cited by examiner

*Primary Examiner*—Thomas M. Sember
(74) *Attorney, Agent, or Firm*—McGlew and Tuttle, P.C.

(57) ABSTRACT

A stretchable and shrinkable tree light string including a long trunk with many short pipes. The short pipes have one or many connecting rings. A base frame has a central axis to support the long trunk to stand up straight. Multiple branches connect at one end with a pin to the connecting ring on the short pipe. These branches use the connecting ring as a base pivot point. The branches being centered on the long trunk to be able to stretch out to form a tree shape, and also to be able to fold up to reduce the volume. Single or many sets of light strings, composed of many lamp bulbs, lamp holders, electrical conductors and receptacles, are to be fixed on the branches to establish tree light strings.

7 Claims, 6 Drawing Sheets

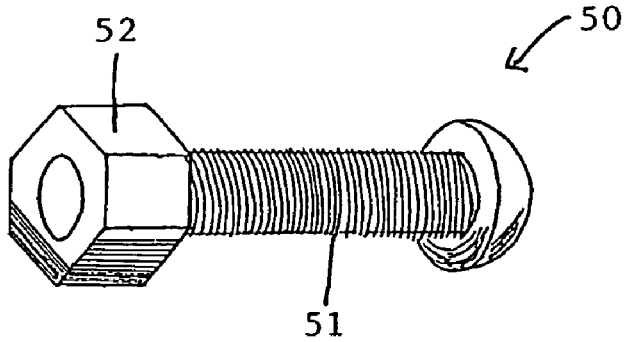
FIG. 7A
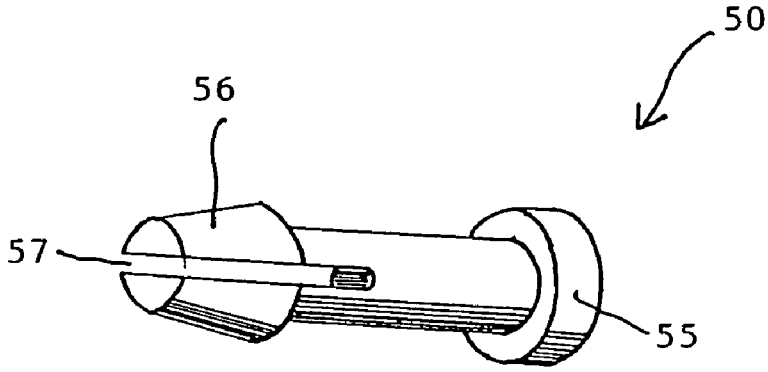
FIG. 7B
FIG. 7

STRETCHABLE AND SHRINKABLE TREE LIGHT STRINGS

FIELD OF THE INVENTION

This application relates to light strings on trees and in particular to trees which expand and contract.

BACKGROUND OF THE INVENTION

A conventional lamp light string set in a Christmas light string includes a lamp bulb, a lamp base, a lamp holder, multiple electrical conductors, receptacles or flasher control, wherein the electrical conductors can be single, double or more than two conductors wound into an electrical circuit. The distributed conductors can be formed in one, two or more than two electrical conductors, such as the FIG. 4 of U.S. Pat. No. 4,241,387, and the FIGS. 1 and 2 of the prior art in this case. In general, the electrical conductors are to be wound in the trees. This is troublesome and monotonous. Further, such kind of work has been used for several years. The present invention is an improvement in the defects of the conventional products. The present invention uses artificial trunks and branches of the tree to make the decorative light strings along with the electrical connectors wound on the trees, so that the decorative light strings and branches of trees form a shape that obtains a decorative effect.

SUMMARY OF THE INVENTION

It is a primary object of the present invention to make a conventional Christmas light strings easy to transport and to improve upon the defects of the conventional products. The present invention is to use a kind of stretchable and shrinkable tree light strings, including a long trunk to be composed of many short pipes. The short pipe has one or many connecting rings. A base frame has a central axis to support a long trunk and to stand up straight. Multiple branches connect at one end with a connecting ring on the short pipe. The branches use the connecting ring as a base point. The end of the branch is at the center of the trunk. The branches are able to stretch out to form a tree shape and also can be folded up to reduce the volume. Single or multiple sets of light strings, composed of many lamp bulbs, lamp holders, electrical conductors and receptacles, are fixed on the branches to establish tree light strings.

The present invention provides stretchable and shrinkable tree light strings. One of its characteristic is to use a connecting ring on the short pipe, surrounding and containing the fixed circumferentially outer edges of the short pipe. Many vanes extend from the connecting ring and connect with branches.

The present invention relates to stretchable and shrinkable tree light strings and another characteristic is that at a side of the vane of the connecting ring is a hole to connect with the branch.

The present invention relates to stretchable and shrinkable tree light strings and another characteristic is to use the base part of branches to form a round shape with a hole on a central part to connect with the connecting ring.

The present invention relates to stretchable and shrinkable tree light strings and another characteristic is that the base part of the branch is to be put between two vanes, with holes aligned with each other. A pin goes from one end of the vane through its hole, then through the hole of the base part of branch to another hole of the vane. The pin is fixed and the pin is used as an axis to make branches being stretchable and shrinkable freely.

The present invention relates to stretchable and shrinkable tree light strings and another characteristic is to form the pin as a screw and screw cap. After the screw goes through the several holes, the screw cap is fastened and fixed tightly.

The present invention relates to stretchable and shrinkable tree light strings and another characteristic is to form the pin with a twin head having flange. One end of the twin head has a horizontal ditch to divide the flange into two halves. Then these two half flange are compressed to reduce the outside diameter of two half flanges. After going through the holes of the vane and branches, flange is restored to expand. Two heads of the flange are to wedge twin vanes, so that the branches are not loosened.

The present invention relates to stretchable and shrinkable tree light strings and another characteristic is to use a light string attached to a protection device, transformer or functional control device to increase decorative function.

Another embodiment of the present invention includes a long trunk to be composed of many short pipes. The short pipe has one or many connecting rings A base frame has a central axis to support the long trunk in order to stand up straight. Multiple branches have a base part forming a round shape and there is a hole on the central part between two vanes. The holes are aligned with each other. A pin goes from one end of the vane through its hole, then through the hole of the base part of the branch to another hole of the vane. The pin is fixed, and the pin is used as an axis to make branches being freely stretchable and shrinkable. Single or multiple sets of light strings, composed of many lamp bulbs, lamp holders, electrical conductors and receptacles, are fixed on the branch to establish tree light strings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

FIG. 7A is a perspective view of the screw and screw cap of the present invention;

FIG. 7B is a perspective view of the pin of the present invention.

DESCRIPTION OF THE PREFERRED EMBODIMENTS

For the convenience of the description, the same part is shown using the same number in all of the drawings.

Figure 1:
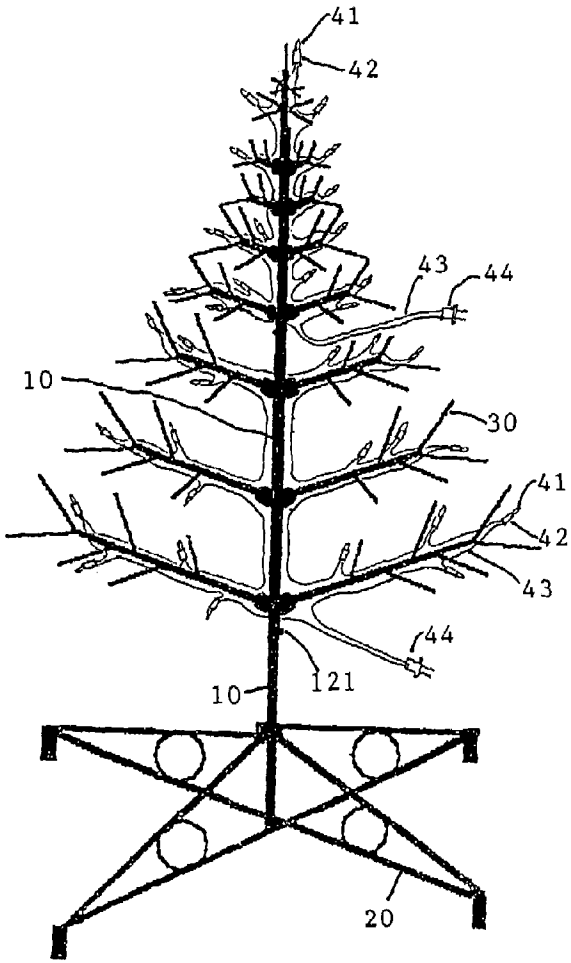
FIG. 1 is a perspective view in 3-dimensions showing the practical structure of the stretchable and shrinkable tree light strings of the present invention.

Now, referring to FIG. 1, it is a perspective view of the stretchable and shrinkable tree light strings of the present invention. The light string set of the present invention includes a long trunk 10, connected with many short pipes 11. The short pipes 11 have one or many connecting rings 12 with flanges 121. A base frame 20 has a central axis 22 to support the long trunk 10 standing up right. Branches 30 use at one end a pin 50 to connect with connecting ring 12 on the short pipe. The connecting ring 12 is used as base point. Branch 30 uses the long trunk 10 as a center to expand and form a tree shape. The branches also can be folded up to reduce the volume. Single or many sets of light strings 40, each composed of a lamp bulb 41, a lamp holder 42, an electrical conductor 43 and a receptacle 44, are fixed on the branches to form the tree lamp.

Figure 2:
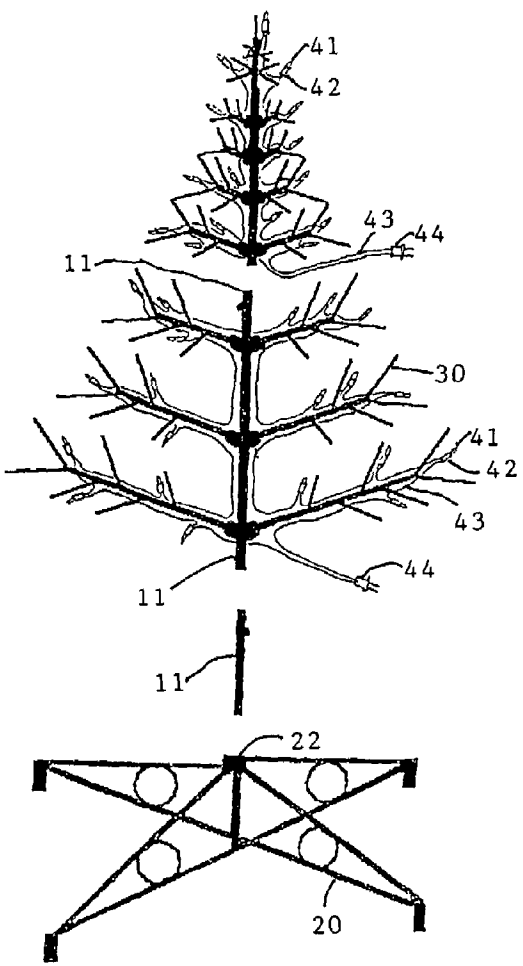
FIG. 2 is a perspective view of the preferred embodiment of the connection style of the stretchable and shrinkable tree light strings of the present invention.

FIG. 2 relates to the connection style of the stretchable and shrinkable tree light strings of the present invention. The base frame 20 has central axis part 22, to be able to support long trunk 10 standing up right. Between the long trunk 10 and the base frame 20, a hollow short pipe 11 not having branches, is provided in the light string to increase the distance between the light string and supporting face. There are many branches 30 connected on the long trunk.

Figure 3A:
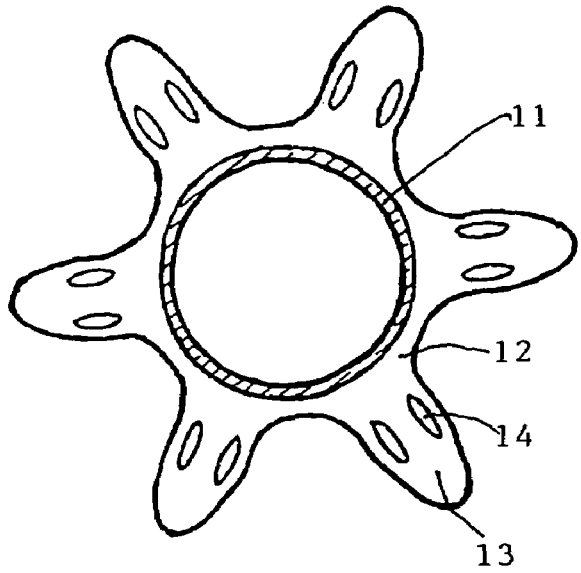
FIG. 3A is a cross section view of the connecting ring on the short pipe of the present invention.
Figure 3:
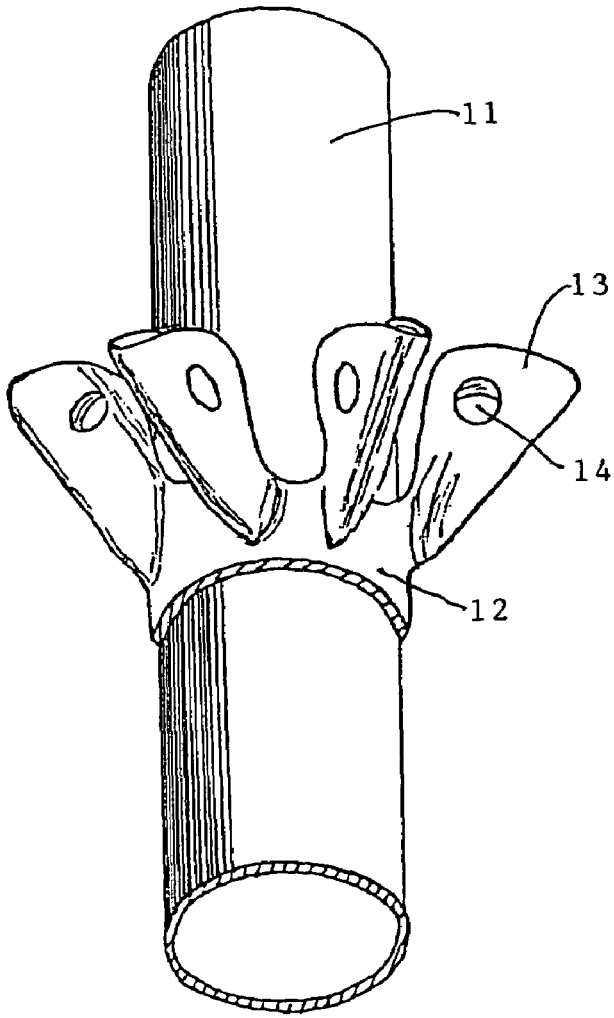
FIG. 3 is a perspective view showing the structure of the short pipe of the present invention.

FIG. 3 is a perspective view showing the structure of short pipe of the present invention. The connecting ring 12 on the short pipe 11 is used to surround and contain the fixed circumferentially outer edge of short pipe. Many vanes 13 extend from the connecting ring 12 and then connect with branches 30.

FIG. 3A is a cross sectional view of the connecting ring on the short pipe of the present invention. The connecting ring 12 surrounds the outer edge of short pipe 11. The connecting ring 12 uses the hole 14 located on the lateral side of vane 13 to connect with a branch.

Figure 4:
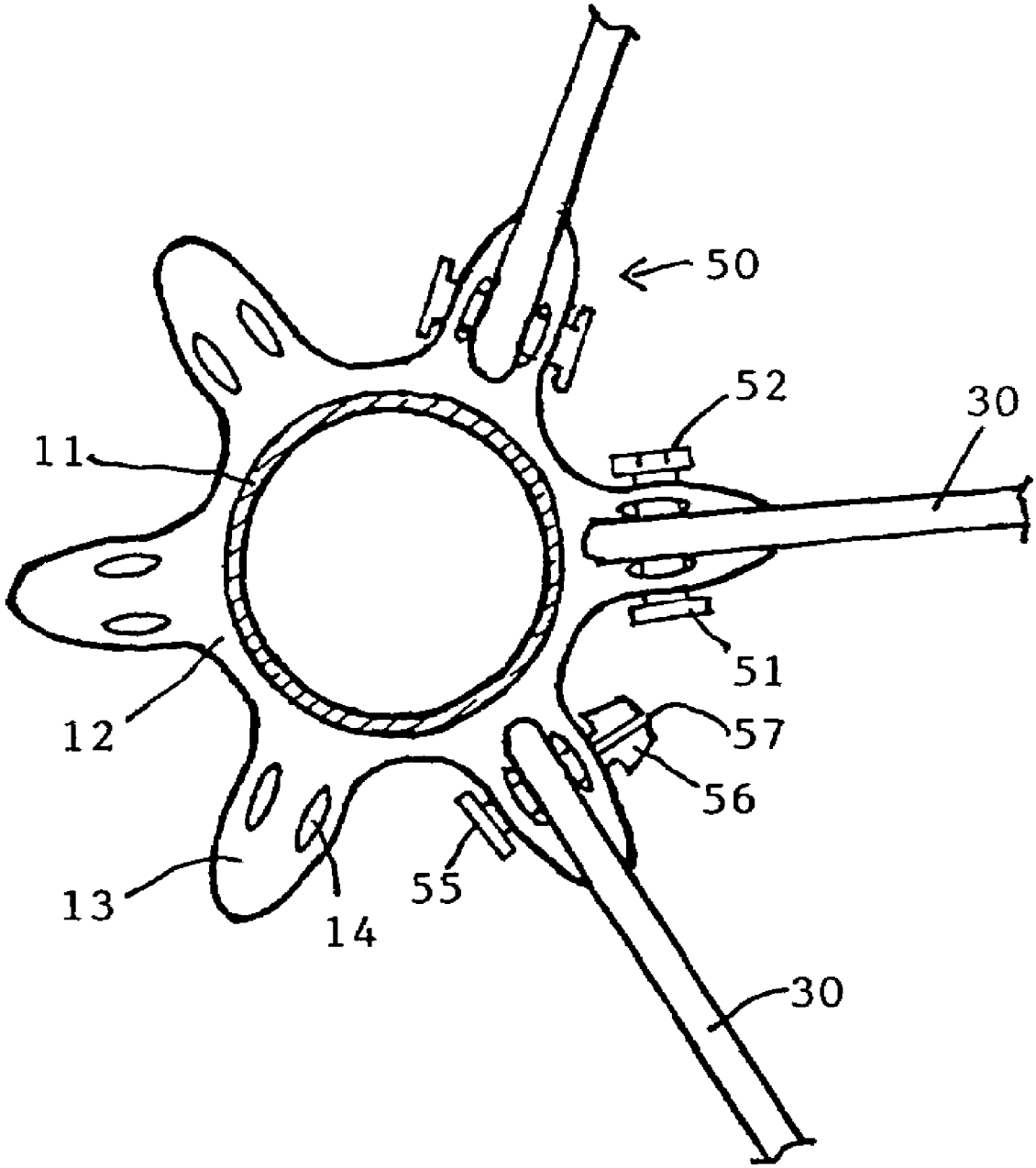
FIG. 4 is a perspective view of the connection of the connecting ring on the short pipe to the branches in the present invention.

FIG. 4 is a perspective view of the connection position of the connecting ring 12 on the short pipe 11 and of the branches 30 in the present invention. A branch base part 31 is put between two vanes 13, and respective holes are aligned with each other. The pin 50 goes through a hole at one end of the vane 13, then goes through the hole of the branch base part 31 to another hole of the vane. The pin is then fixed. The pin 50 forms an axis to make branches be stretchable and shrinkable freely.

Figure 5:
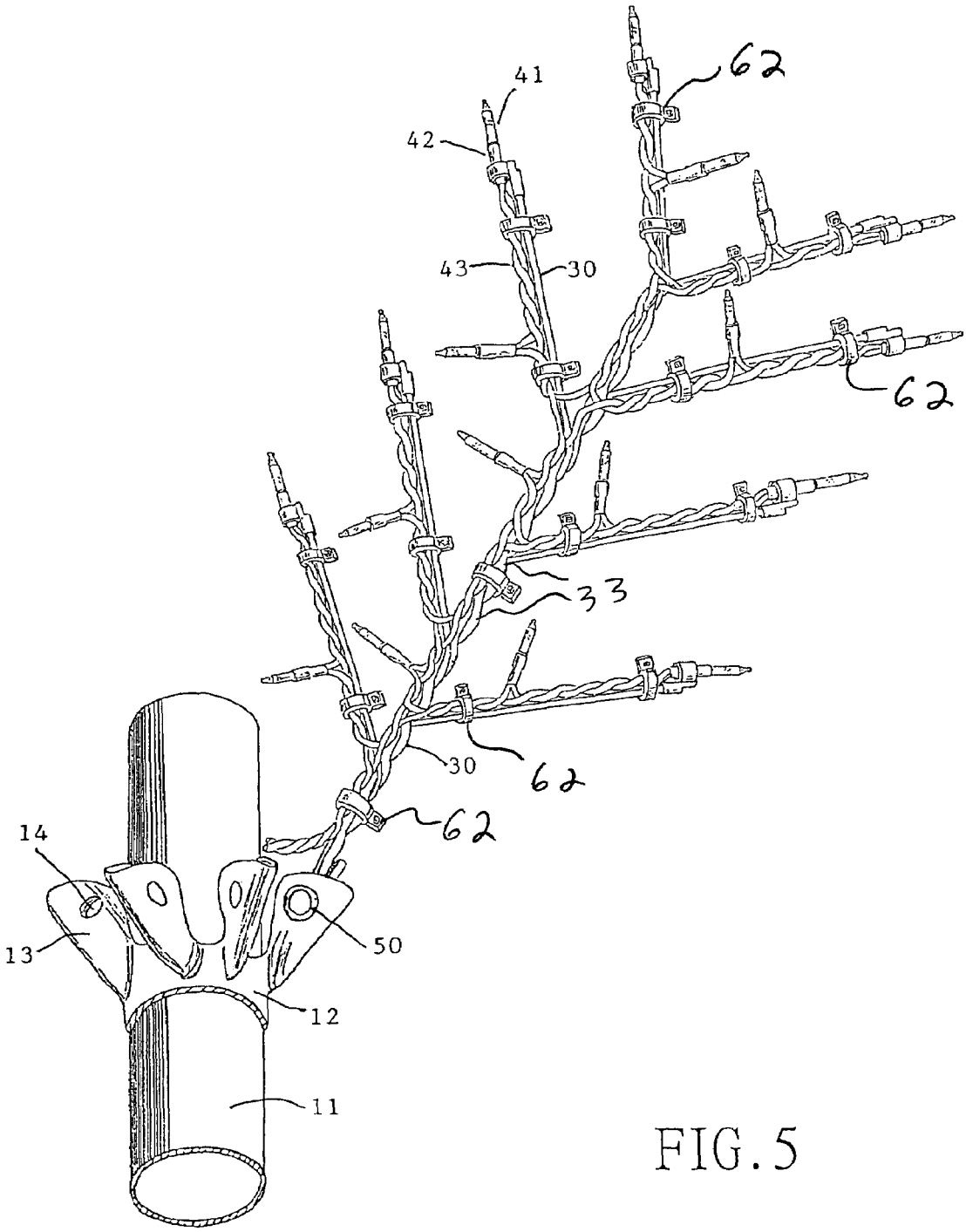
FIG. 5 is a perspective view of the structure of the long trunk and light string of the present invention.

FIG. 5 is a perspective view of the structure of the long trunk and light string of the present invention. The long trunk is composed of many short pipes 11, and connecting ring 12 attached to short pipe 11. The connecting ring 12 has vane 13 which equipped with hole 14. It is to connect to many pillared branches 30, and its base part is to form an annular shape with a hole in the center. Branches 30 are put in between vane 13. One end of the pin goes through the hole in the vane 13, and then fixed through the hole on the branch. The pin is used an axis, and single or many sets of light strings on the branch are used. The light string is composed of many lamp bulbs 41, lamp holders 42, an electrical conductor 43 and a receptacle. A fixing device is used and fixed on the branch. The fixing device is able to use movable clip 62 to fix the light string on the tree lamp so as to establish decorative tree lamp. Besides, the branch 30 is also able to use a single pillar.

Figure 6:
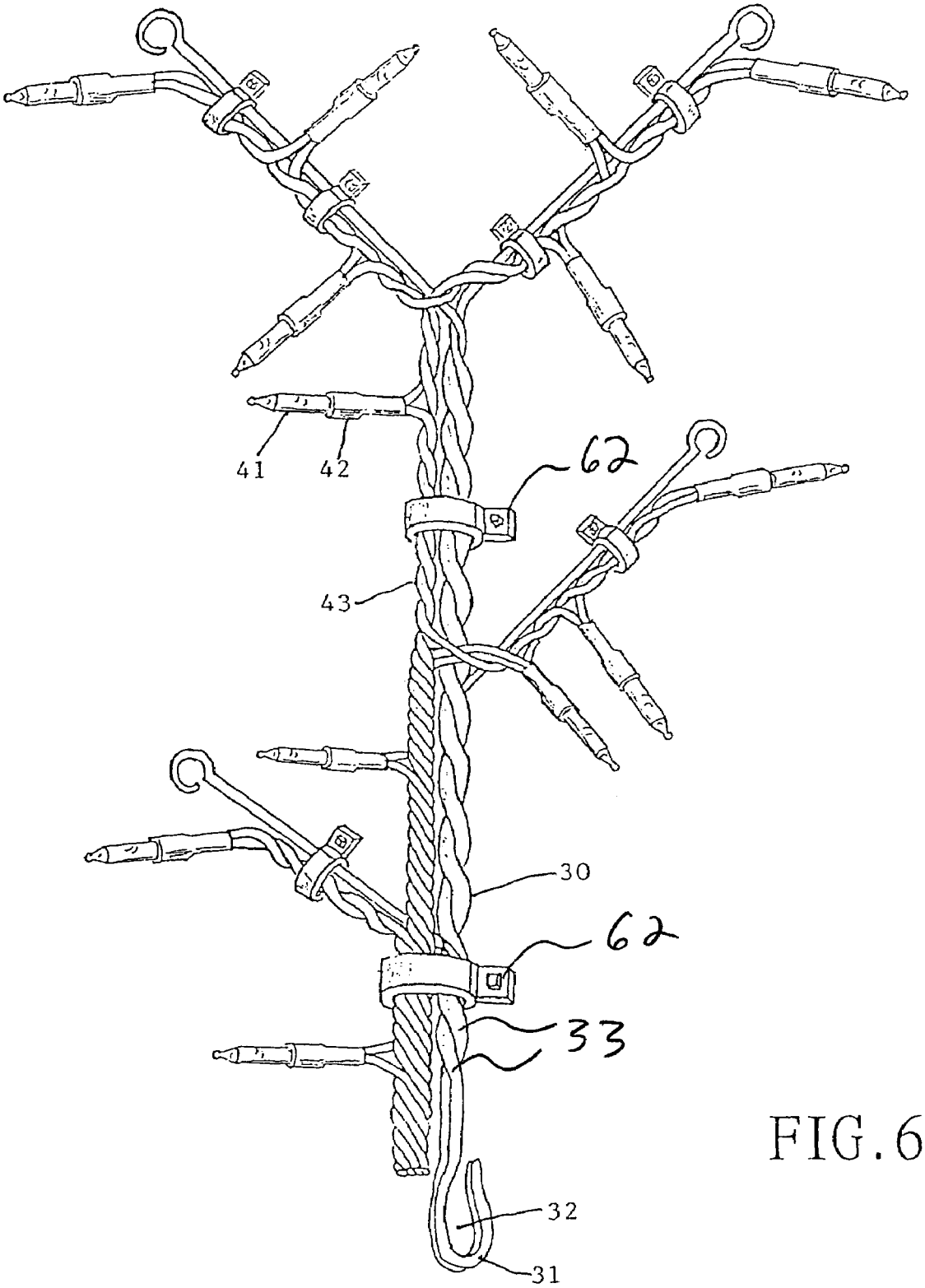
FIG. 6 is a perspective view of single or multiple branches of a further embodiment of the present invention.

FIG. 6 is a structure of further embodiment of a single or multiple branches of the present invention. The base part 31 of branch 30 is to form an annular shape. In the center of the shape is a hole 32. The base part is put between two vanes on the connecting ring, and one end of the pin goes through the hole on the vane, through the hole on the branch and fixed. The pin is used as an axis and the other end of the branch is to use the long trunk as center. The branch is able to expand into a tree shape and also can be folded up to reduce volume.

FIG. 7 is a structural drawing of the pin or the screw and screw cap of the present invention. FIG. 7A is the structural drawing of the screw 51 and screw cap 52. The pin 50 is formed by the screw 51 and screw cap 52. FIG. 7B is a form of the pin 50 with a twin head having protuberance 55, 56. One end has horizontal ditch 57, dividing the protuberance into two parts. Compressing these two half parts of the protuberance, reduces the outside diameter of the two half parts of the protuberance. After going through holes of the vane and branches, the protuberance restored to an expanded state. The two head protuberances are used to wedge twin vanes, so that the branches are not loose.

As can be seen from FIGS. 5 and 6, each of the branches 30 include support strands 33 twisted together. The electrical conductors 43 are also twisted together. The clips 62 are arranged around the electrical conductors 43 and the support strands 33 of the branches 30 to hold the plurality of light strings to the branches 30.

From the foregoing it will be appreciated that although specific embodiments of the invention have been described herein for purposed of illustration, various modifications and improvements thereon will become readily apparent to those skilled in the art. Accordingly, the appended claims are to be construed broadly and in a manner consistent with the spirit and scope of the invention described herein.

While specific embodiments of the invention have been shown and described in detail to illustrate the application of the principles of the invention, it will be understood that the invention may be embodied otherwise without departing from such principles.

APPENDIX

| | |
|---|---|
| 1 | light string set |
| 10 | long trunk |
| 11 | short pipe |
| 12 | connecting ring |
| 121 | flange |
| 13 | vane |
| 14 | hole |
| 20 | base frame |
| 22 | central axis part |
| 30 | multiple branches |
| 31 | base part |
| 32 | hole |
| 40 | single or many set light string |
| 41 | lamp bulb |
| 42 | lamp holder |
| 43 | electrical conductor |
| 44 | receptacle |
| 50 | pin |
| 51 | screw |
| 52 | screw cap |
| 55, 56 | protuberance |
| 57 | horizontal ditch |

What I claimed is:

1. A stretchable and shrinkable light string tree comprising:

a long trunk including many short pipes, the short having many connecting rings with vanes;

a base frame with a central axis to support said long trunk to stand up straight;

multiple branches, a base part of the branches form a round shape and a hole being defined on the round shape, said round shape being arranged between two said vanes with said holes aligned with each other;

a pin extending from one side of the vane going through its hole, then going through the hole of the branch to another hole of the vane, the pin being fixed and used as an axis to make said branches being stretchable and shrinkable freely;

single or multiple sets of light strings, each composed of many lamp bulbs, lamp holders, electrical conductors and receptacles, to be fixed on the branches to establish tree light strings.

2. A stretchable and shrinkable light string tree as claimed in claim 1, wherein said connecting ring on the short pipe surrounds a fixed circumferentially outer edge of said short pipe, many of said vanes extend from said connecting ring and connect with said branches.

3. A stretchable and shrinkable light string tree as claimed in claim 1, wherein the pin is a screw and screw cap, after the screw goes through said several holes, the screw cap being fastened and fixed tightly.

4. A stretchable and shrinkable light string tree as claimed in claim 1, wherein the pin has a twin head having a flange, one end of said twin head having a horizontal ditch to divide the flange into two halves, compressing of these two half reducing an outside diameter of the flange, after going through the holes of the vane and branches, said flange being restored to expand in said vanes, so that the branches not loosened.

5. A stretchable and shrinkable light string tree as claimed in claimed 1, wherein a protection device, transformer or functional control device is attached to said one of said light strings to increase decorative function.

6. A stretchable and shrinkable light string tree comprising:

a trunk including many pipes connected to each other;

a plurality of connecting rings mounted on said pipes, each of said connecting rings including a plurality of vanes, each of said vanes has two sides which defines a hole;

a base frame connected to said trunk and having a central axis to support said trunk to have said trunk stand up straight;

multiple branches connected to said connecting rings, each of said branches including support strands twisted together, one end of said each branch defining a branch hole;

a plurality of pins, each pin extending through said holes in one of said vanes and a respective said branch hole to pivotally connect a respective said branch to a respective said vane between a first position arranging said branches to form a tree shape and another position having a reduced volume;

a plurality of light strings arranged on said branches, each said light string including a plurality of lamp bulbs, lamp holders, electrical conductors and receptacles, said electrical conductors being twisted together;

a plurality of clips arranged around said electrical conductors and said support strands of said branches to hold said plurality of light strings to said branches.

7. A tree in accordance with claim 6, wherein:

said vanes are spaced from each other by a distance large enough for said pin to be inserted and removed from a respective said vane.

* * * * *

US007055981C1

(12) EX PARTE REEXAMINATION CERTIFICATE (10260th)

United States Patent

Yao

(10) Number: US 7,055,981 C1

(45) Certificate Issued: Aug. 18, 2014

(54) STRETCHABLE AND SHRINKABLE TREE LIGHT STRINGS

(75) Inventor: Joseph Yao, Taipei (TW)

(73) Assignee: Willis Electric Co., Ltd., Hsin-Chu (TW)

Reexamination Request:
No. 90/012,209, Mar. 26, 2012

Reexamination Certificate for:

| | |
|---|---|
| Patent No.: | **7,055,981** |
| Issued: | **Jun. 6, 2006** |
| Appl. No.: | **10/677,915** |
| Filed: | **Oct. 2, 2003** |

(30) Foreign Application Priority Data

Mar. 11, 2003 (CN) ..... 03238504

(51) Int. Cl.
*F21V 21/00* (2006.01)

(52) U.S. Cl.
USPC ..... 362/123; 362/249.19; 362/806; 428/20

(58) Field of Classification Search
None
See application file for complete search history.

(56) References Cited

To view the complete listing of prior art documents cited during the proceeding for Reexamination Control Number 90/012,209, please refer to the USPTO's public Patent Application Information Retrieval (PAIR) system under the Display References tab.

*Primary Examiner* — John S Heyman

(57) ABSTRACT

A stretchable and shrinkable tree light string including a long trunk with many short pipes. The short pipes have one or many connecting rings. A base frame has a central axis to support the long trunk to stand up straight. Multiple branches connect at one end with a pin to the connecting ring on the short pipe. These branches use the connecting ring as a base pivot point. The branches being centered on the long trunk to be able to stretch out to form a tree shape, and also to be able to fold up to reduce the volume. Single or many sets of light strings, composed of many lamp bulbs, lamp holders, electrical conductors and receptacles, are to be fixed on the branches to establish tree light strings.

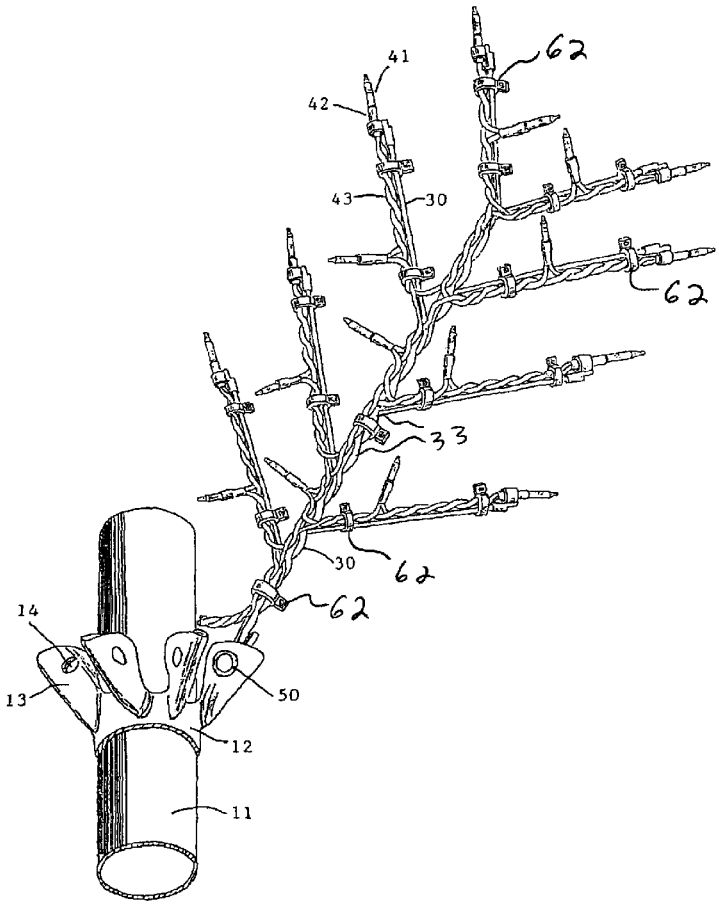

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-7 are cancelled.

* * * * *